United States Patent [19]

Sauer

[11] 4,075,585

[45] Feb. 21, 1978

[54] ELECTROMAGNETIC RELAY AND THE MANUFACTURE THEREOF

[75] Inventor: Hans Sauer, Fichtenstrasse 5, 8024 Deisenhofen, Germany

[73] Assignees: Matsushita Electric Works, Ltd., Osaka, Japan; Hans Sauer, Deisenhofen, Germany; part interest to each

[21] Appl. No.: 639,406

[22] Filed: Dec. 10, 1975

[30] Foreign Application Priority Data

Dec. 13, 1974 Germany ..... 2459039

[51] Int. Cl.[2] ..... H01H 51/22

[52] U.S. Cl. ..... 335/78; 335/179

[58] Field of Search ..... 335/78, 202, 80, 79, 335/81, 83, 86, 302, 106, 177, 178, 179

[56] References Cited

U.S. PATENT DOCUMENTS

| | | | |
|---|---|---|---|
| 3,522,564 | 8/1970 | Mori et al. | 335/78 |
| 3,946,347 | 3/1976 | Sauer | 335/78 |
| 3,993,971 | 11/1976 | Ono et al. | 335/78 |

*Primary Examiner*—Harold Broome
*Attorney, Agent, or Firm*—Wigman & Cohen

[57] ABSTRACT

An electromagnetic relay comprises a coil bobbin of plastic material defining a protective tube, a contact chamber and a magnet chamber which together form a space that extends the entire length of the bobbin and is initially open at both ends. A permanent magnet is disposed in the magnet chamber, serving to seal one end of the space. This magnet has a surface exposed to the contact chamber and is made of a material activatable as a getter. A contact actuator is mounted to extend along the protective tube with a free end extending into the contact chamber. A pair of pole shoes each have a first end in proximity to the permanent magnet and a second end extending into the contact chamber. These second ends form fixed contacts for cooperation with the free end of the contact actuator. After assembly of these parts the space is subjected to a vacuum and an elevated temperature to drive off moisture and activate the getter. The vacuum is then replaced with an atmosphere of a protective gas, and the other end of the space is sealed with a closure.

47 Claims, 19 Drawing Figures

ELECTROMAGNETIC RELAY AND THE MANUFACTURE THEREOF

The present invention relates to an electromagnetic relay.

More specifically a the invention relates to a relay of the type comprising an actuator arranged within a protective tube formed in a coil bobbin. A pair of pole shoes have inner ends arranged in a contact chamber also formed in the bobbin and connected with the protective tube, the arrangement being such that these ends of the pole shoes are disposed on opposite sides of said actuator. The pole shoes also have outer ends disposed in the proximity of a permanent magnet arranged in a magnet chamber also formed in the bobbin, the latter being open at both ends.

For the purpose of protecting the contacts of this type of relay, the terminals extending therefrom are embedded in insulating material. In order to ensure maximum reliability of the contacts and the maintenance of accurately predetermined contact resistance values, the contact chamber, prior to final assembly, is cleaned in an ultrasonic cleaning bath, degassed in a vacuum in the presence of heat and finally closed by means of a specially designed housing can. As it is relatively difficult to obtain access to the contact chamber, it is necessary to exercise special care in the cleaning with an ultrasonic cleaning bath. The necessity to close the contact chamber before the embedding operation tends to increase the cost of manufacture. Another economic disadvantage is to be found in the necessity of using electroplated contacts in view of the fact that, due to the manufacturing methods employed, surfaces to be gold- or rhodium-plated would have to be much larger than would be necessary for satisfactory operation of the contacts.

Another disadvantage of the known relay resides in the fact that a relatively large distance between the ends of the pole shoes and the adjacent end of the coil chamber tends to promote the occurrence of stray losses which cause the efficiency of the relay to be reduced. While it is known to increase the efficiency of the magnet system of a relay by using larger pole surfaces, the use of larger pole surfaces tends to introduce adjustment difficulties or to shorten the creep paths at those ends of the current-carrying pole shoes which are adjacent the respective terminals.

It is the object of the present invention to provide a relay in which the contact system is particularly easily accessible for cleaning purposes and which is capable of being manufactured on a mass-production scale without using potting compound, while being perfectly sealed from its environment in an economical manner.

This object is achieved by providing, according to the invention, an electromagnetic relay comprising (a) a bobbin of plastic material defining therein a protective tube, a contact chamber and a magnet chamber that together form a space which extends the entire length of the bobbin and is open at both ends, (b) a permanent magnet disposed in the magnet chamber to seal one end of said space, (c) a contact actuator mounted to extend along the protective tube with a free end extending into the contact chamber, (d) a pair of pole shoes each having a first end disposed in proximity to the permanent magnet and a second end extending into said contact chamber, said second ends forming fixed contacts for cooperation with said free end of the contact actuator, (e) a coil mounted on the bobbin, (f) means activatable as a getter and disposed in said space, and (g) a closure sealing the other end of said space opposite said permanent magnet.

The manufacturing of the electromagnetic relay comprises (a) assembling (i) a bobbin of plastic material defining therein a protective tube, a contact chamber and a magnet chamber that together form a space which extends the entire length of the bobbin and is open at both ends, (ii) a contact actuator mounted to extend along the protective tube with a free end extending into the contact chamber, (iii) a coil on the bobbin, (iv) a permanent magnet made of a material activatable as a getter and disposed in the magnet chamber to seal one end of said space while having a surface exposed to the contact chamber, and (v) a pair of pole shoes each having an outer end in the magnet chamber in proximity to the permanent magnet and an inner end extending into the contact chamber to form a fixed contact for cooperation with said free end of the actuator, (b) subjecting the space to a vacuum and an elevated temperature to drive off moisture and activate the getter, (c) replacing the vacuum with an atmosphere of a protective gas, (d) and sealing the other end of the space with a closure.

The presence of a coil bobbin which is open at both ends makes it possible in a particularly easy and efficient manner to clean or degas the contact chamber and the interior of the protective tube. Such a cleaning operation will be necessary regardless of the type of relay involved in order to remove any contamination of the contacts such as organic deposits consisting of adhesives or substances evaporated from the coil bobbin during manufacturing operations. Such a cleaning operation is usually performed immediately prior to hermetic sealing of the contact chamber, for example, by the insertion of the permanent magnet, and this cleaning operation is of considerable importance as regards the properties of the contacts.

In order to ensure the development of large contact forces, the second ends of the pole shoes extend into the contact chamber where the stray flux is at a minimum, these ends of the pole shoes forming fixed contacts extending parallel to the actuator. It is, however, unnecessary to adjust the pole shoes, since they can be positively held in position by being embedded in the coil bobbin. To achieve this result, in a preferred embodiment, the first ends of the pole shoes are connected to respective terminals and are embedded in the walls of the magnet chamber in such a manner that each pole shoe has exposed portions on opposite sides thereof, the pole shoes being surrounded on both sides by the material of the coil bobbin, and the exposed portions being arranged in the magnet chamber in the vicinity of the respective end faces of the coil bobbin.

In order that the invention may be more fully understood, embodiments thereof will be described in the following text by way of example, with reference to the accompanying drawings, in which.

Figure 1:
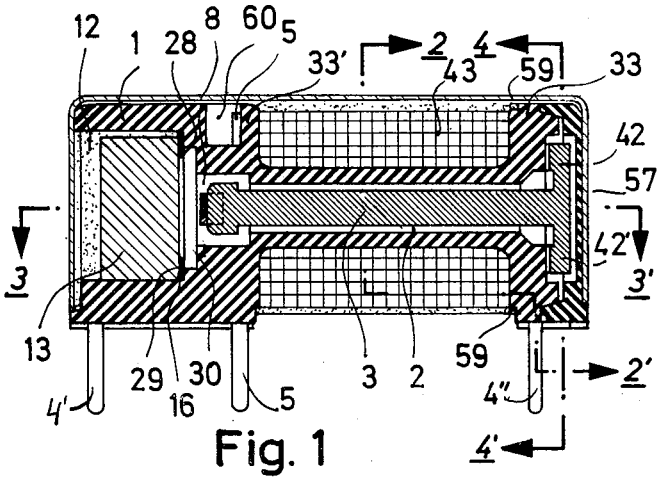
FIG. 1 is a cross section along line 1—1' in FIG. 3 showing a relay having a single-piece coil bobbin.
Figure 2:
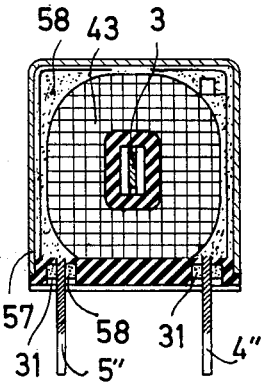
FIG. 2 is a cross section along the line 2—2' in FIG. 1.

The relay shown in FIGS. 1–4 comprises a singlepiece coil bobbin 1 made of a plastic material, a central cavity of such bobbin forming a protective tube 2 in which is arranged an actuator 3. Embedded in a right-hand bobbin flange 33 is a contact carrier 40 (FIG. 3) forming a terminal of a central contact. The contact carrier 40 comprises an end portion extending at an angle to its main portion, such end portion having exposed portions, 41, 41′ (FIG. 4) to which root end portions 42, 42′ (FIG. 1) of the actuator 3 are secured as by spot welding. Another bobbin flange 33′ has fixedly embedded therein two pole shoes 6 and 7 having inner portions which extend towards a central plane of the relay. Innermost end portions 18, 19 of these pole shoes extend parallel to one another and to the longitudinal axis of the bobbin 1 and are provided on their surfaces with a contact material 20 rolled into or onto said end portions.

The protective tube 2, a contact chamber 8 and a magnet chamber 12 initially form a continuous space extending the entire length of the bobbin, i.e., between its end faces 14 and 15, such space being open at these ends so that the contacts 20 and all the inner wall surfaces of the inner space are accessible for an efficient cleaning operation, which may be performed, for example, in an ultrasonic cleaning bath. The contact chamber 8 is closed and sealed by a permanent magnet 13 which is arranged within the bobbin flange 33′ in abutment against a supporting surface 16 to which the permanent magnet 13 is preferably connected by means of a piece of foil material 28 coated on both sides with an adhesive and shaped in such a manner that it extends substantially only over peripheral portions 29 of the permanent magnet 13.

Figure 3:
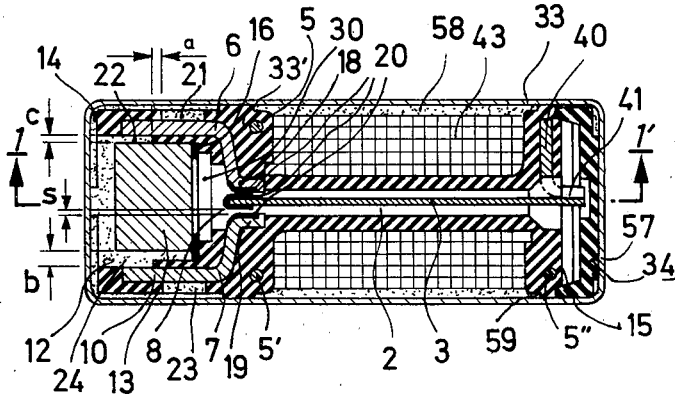
FIG. 3 is a cross section along line 3—3' in FIG. 1.
Figure 4:
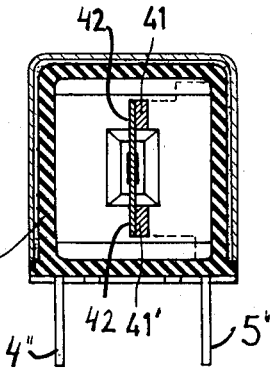
FIG. 4 is a cross section along line 4—4' in FIG. 1.

The pole shoes 6, 7 embedded in the bobbin flange 33′ are located on opposite sides thereof with exposed portions 21, 22, 23, 24 which, as seen in FIG. 3 are offset in relation to one another in the longitudinal direction by a distance *a*. These exposed portions and the longitudinal spacing *a* are necessary to accurately define the transverse distance between the inner end portions 18, 19 of the pole shoes 6, 7 which are also provided with contact material 20 during the embedding thereof in the plastic material of the bobbin 1 which is manufactured by an injection moulding, pressing or injection pressing operation. During the embedding operation, the exposed portions 21, 23 of the pole shoes 6, 7 are engaged by laterally arranged slide members of a manufacturing tool via the exposed portions 22, 24 and 18, 19 of the pole shoes 6, 7, the result being that the respective portions are forced against a punch member inserted into the manufacturing tool from one end thereof, such punch member being adapted to determine with sufficient accuracy the profile of the contact chamber 8 and the magnet chamber 12 and hence the distance between the inner end portions 18, 19 of the pole shoes 6, 7 contributing to the attainment of the correct contact spacing.

After the bobbin 1 has been provided with an energizing coil 43 and after such coil has been connected to coil terminals 5, 5′, 5″, the actuator 3 is adjusted in relation to its root portions 42, 42′, in such a manner that it may assume a rest position on one or other side, or in its centered position, depending on the contemplated use of the relay. Subsequent to this adjustment, the relay is simultaneously subjected to a vacuum of about $10^{-5}$ torr and a temperature between 100° and 150° C in order to drive off moisture retained by crystals and at the same time to activate as a getter the permanent magnet 13 which is made of barium ferrite or one or more rare earths. After this operation has been completed, the vacuum is replaced by a protective gas atmosphere which is at a normal pressure of about 760 torr, and a sealing cap 34 is applied to close the protective tube 2 and the contact chamber 8. Hermetic sealing of the bobbin cavity is preferably effected by means of an ultrasonic welding process or by means of a process in which a preheated plate is used. In order to enhance the effectiveness of the ultrasonic welding operation serving to connect the sealing cap 34 to the bobbin flange 33, such flange is provided on its side facing away from the sealing cap 34 with a peripheral shoulder 59 serving as an abutment for the anvil of the ultrasonic welding device.

For the purpose of providing magnetic screening and of increasing the magnetic efficiency of the relay, there is provided a housing can 57 made of a ferromagnetic material for enclosing the relay. Such housing can being fixed in position by means of a potting compound 58, for example, a casting resin. This arrangement tends to improve consideraly the sealing effect and both the mechanical and functional stability of the relay. In cases in which the bobbin 1 is made of a thermoplastic material, it is convenient to provide recesses 31 surrounding the contact terminals 4, 4′, 4″ and the coil terminals 5, 5′, 5″, such recesses being at least partially filled with potting compound 58, which is dimensionally more stable than thermoplastic materials, so that the accuracy with which the contact and coil terminals are held in position will not be impaired by any higher-than-average heating during soldering operations.

Bobbin flange 33′ has formed therein a space or cavity 60 which extends between the coil terminal 5 and the coil terminal 5′ and is adapted to receive such circuit elements as diodes or resistors. Since in certain cases the getter action of the activated permanent magnet 13 may not be fully sufficient, and because it is necessary under all circumstances to provide a predetermined spacing between the permanent magnet 13 and the adjacent pole shoes, there is provided an additional cavity or space 30 which can receive special type getters or molecular sieves.

Instead of introducing a separate getter material or employing the permanent magnet as the getter, it is also possible to coat the inner walls of the bobbin 1, parts of which form the protective tube 2, with a getter material prior to insertion of the actuator 3; such a coating may be applied in a conventional manner using, for example, the evaporating method employed in the manufacture of electronic tubes. Such a coating will absorb gases exhaled by the plastic material and will thus enhance the dependability of the contacts.

Figure 5:
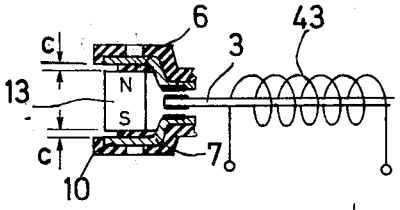
FIG. 5 is a diagrammatic representation of a polarized change-over relay with an actuator that can adopt a centered rest position.
Figure 6:
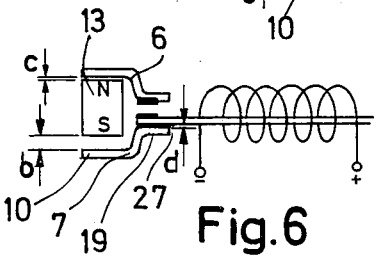
FIG. 6 is a diagrammatic representation of a relay having a normally open contact.
Figure 7:
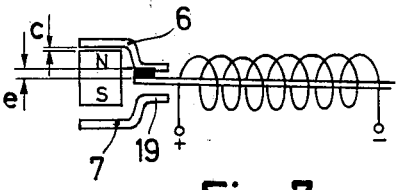
FIG. 7 is a diagrammatic representation of an arrangement resembling that of FIG. 6, but provided with a normally closed contact.

In the case of the relay diagrammed in FIG. 5 in which the actuator may assume two different contact engaging positions or a centered position between the two pole shoes 6, 7, the permanent magnet 13 is centrally arranged between these pole shoes, there being gaps *c* for the purpose of enhancing the electric insulation of the magnet. In a relay of the type shown in FIG. 3, which relay is designed for a rest position of the actuator on one side only, which relay can be provided with a normally open contact as shown in FIG. 6 or a normally closed contact as shown in FIG. 7, the distance *b* (FIGS. 3 and 6) between the permanent magnet 13 and the outer end portion 10 of the pole shoe 7, is larger than the distance *c*. In cases in which a relay is desired that has only a normally open contact as shown in FIG. 6, it is convenient to provide the pole surface of the inner end portion 19 of the pole shoe 7 with a sheet metal separator 27 having a thickness *d* to maintain the response of the relay stable for the entire life of the relay and to reduce adhesion between the actuator 3 and the pole shoe 7. In a relay of the type shown in FIG. 7 having a normally closed contact, the thickness *e* of the layer of contact material is selected along similar lines.

Figure 8:
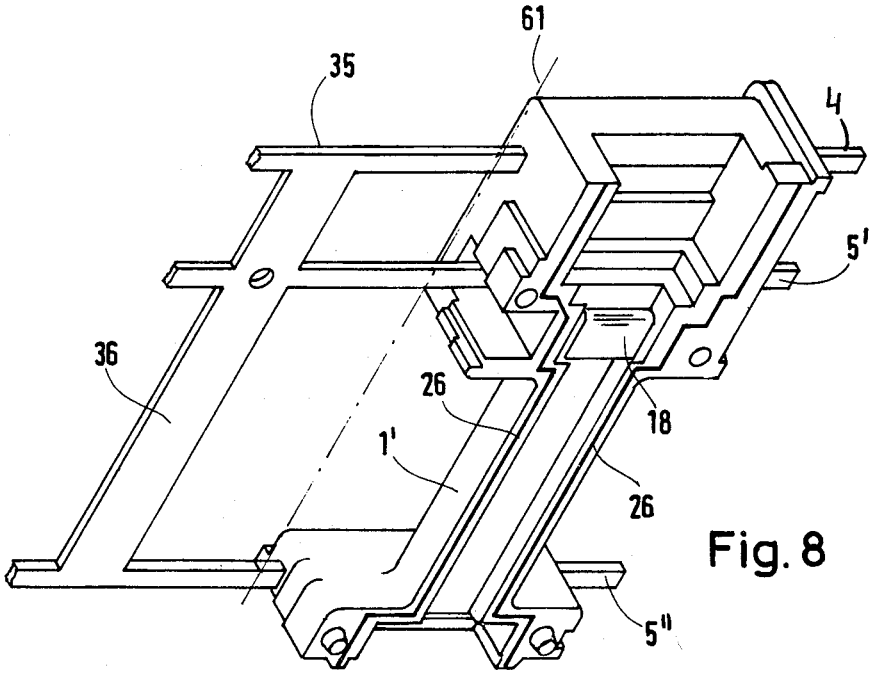
FIG. 8 and FIG. 9 are isometric views of two coil bobbin halves having contact terminals and coil terminals as well as pole shoes embedded therein.
Figure 9:
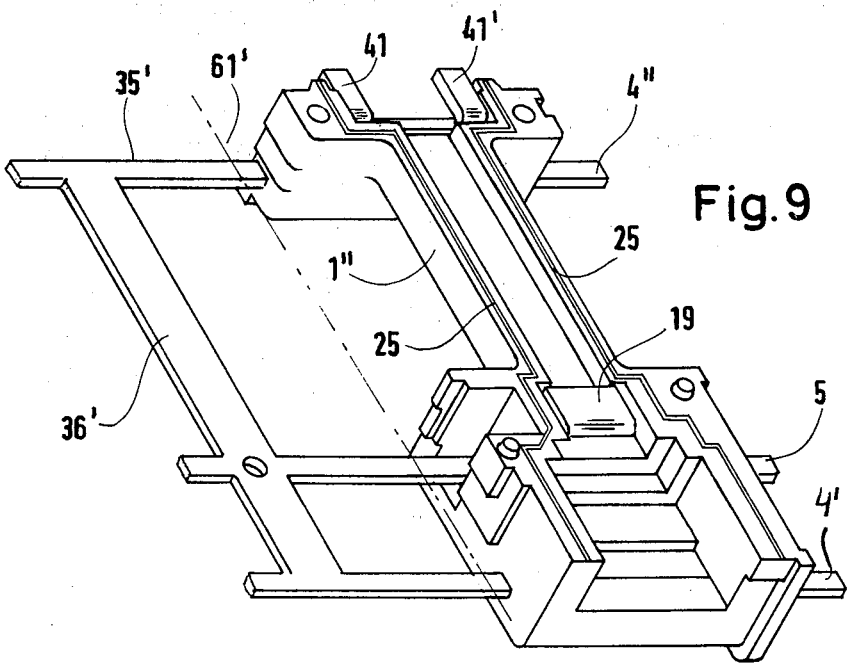
Figure 11:
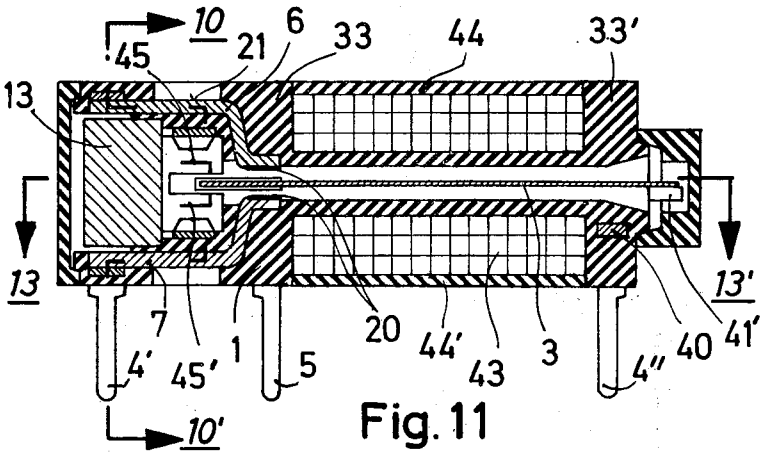
FIG. 11 is a section on 11—11′ in FIG. 13.
Figure 13:
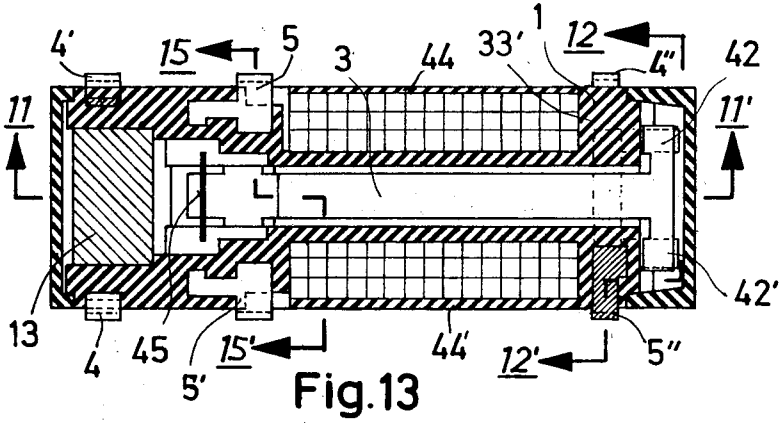
FIG. 13 is a section on 13—13′ in FIG. 11.
Figure 10:
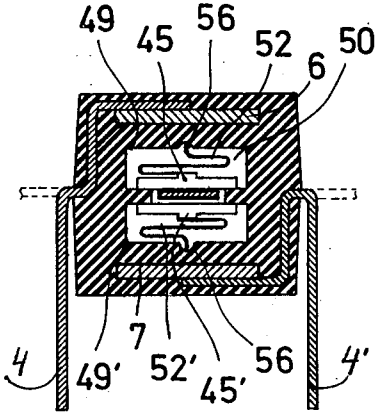
FIG. 10 is a cross section along line 10—10′ in FIG. 11 of a dual-in-line relay.

FIGS. 8 and 9 show the coil bobbin 1 formed as two positively interengageable halves 1', 1'' capable of being welded together and forming part of a relay in which the contact terminals 4, 4', 4'' and the coil terminals 5, 5', 5'' remain connected together by transverse portions 36, 36' until after embedding of said terminals in their respective bobbin halves. A suitable spacing between the contact terminal and coil terminal centers is 5mm. Before the bobbin halves 1', 1'' are welded together, the transverse portions 36, 36' of the respective pre-cut terminal plates 35, 35' are severed in planes 61, 61' indicated in FIGS. 8 and 9 by dot-dash lines. In the present case, the exposed portions 41, 41' serving as contact carriers are formed as parts of the contact terminal 4''.

In the plane separating the casing halves, the casing half 1'' is provided with ridge-like projections 25, whereas the casing half 1' is provided with matching grooves 26 adapted to receive said projections. The projections 25 are so dimensioned that their cross section is smaller than that of the grooves 26. However, the height of the projections 25 is greater than the depth of the grooves 26, so that, during the operation of connecting the two bobbin halves together by means of an ultrasonic welding process, the ensuing deformation of the projections 25 will tend to compensate for unavoidable manufacturing tolerances of the bobbin halves. As it is of primary importance to establish an accurately defined travel *s* (FIG. 3) of the actuator 3, during the welding operation, there is inserted between the inner end portion 18 of the pole shoe 6 and the free end 9 of the actuator 3, which is in contact with the opposite inner end portion 19 of the pole shoe 7, an assembly gauge comprising a tongue having a thickness selected to determine the travel *s* of the actuator 3. In addition to compensating for manufacturing tolerances of the bobbin halves 1', 1'', this arrangement provides for compensation of tolerances or deviations introduced by the thickness of the actuator, including the thickness of the contact material 20.

FIGS. 10–15 show a relay in which the coil bobbin 1 is formed as a so-called dual-in-line relay casing. Relays having their contacts arranged in a protective tube and embedded in dual-in-line casings are described, for example, in U.S. Pat. No. 3,575,678 issued Apr. 20, 1971 to W. F. Barton. In a relay of this type, use is made of a protective tube of glass carrying an energizing coil, the relay comprising terminals connected to a so-called relay carrier. The entire arrangement is embedded in a plastic material having a casing of the "dual-in-line" shape. In known relays of this type, it has been impossible to adjust the characteristic parameters to obtain a satisfactory cooperation between the energizing field and the field of the permanent magnet for the purpose of enabling the relay to be economically controlled by pulses, to operate the relay as a monostable or a bistable device, to obtain large contact forces with a low level of energizing power and to adjust the actuator in a central rest position.

However, when a bobbin 1 forming a protective tube according to the present invention is used in a dual-in-line casing, it is possible to attain almost all the parameters or operating characteristics that may be required of a relay. In the present case, as shown in FIGS. 10–15, contact terminals 4, 4', 4'' and coil terminals 5, 5', 5'' are led out of the bobbin 1 in lateral directions at a central plane and, after embedding in the bobbin, are all bent to extend in a common direction. This arrangement is typical of the "dual-in-line" style of construction.

Figure 12:
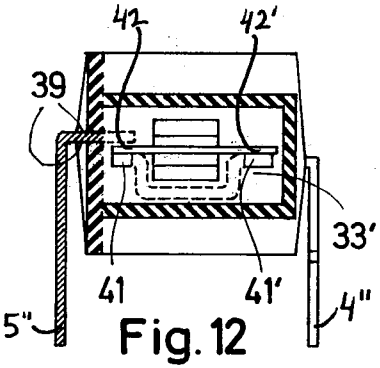
FIG. 12 is a section on 12—12′ in FIG. 13.
Figure 15:
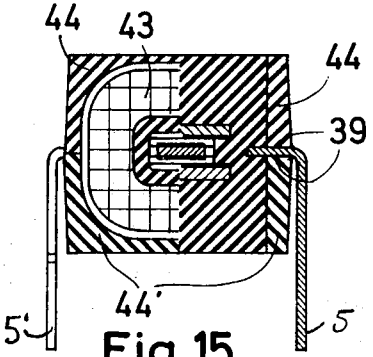
FIG. 15 is a section on 15—15′ in FIG. 13.
Figure 18:
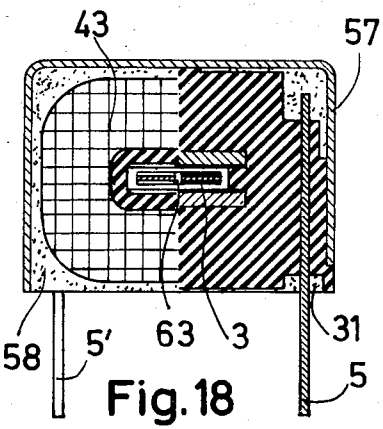
FIG. 18 is a cross section generally similar to FIG. 14, but of a relay having a magnetic screening cap and contact and coil terminals all extending from a single surface of the relay.
Figure 14:
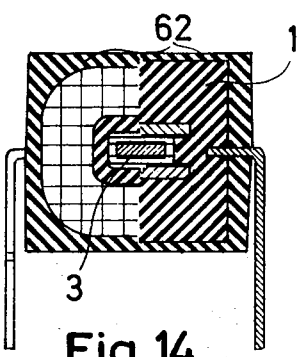
FIG. 14 is a variation of FIG. 15.

In all other respects, the relay of FIGS. 10–15 is designed substantially in the same manner as the embodiment shown in FIGS. 1–4. In order to permit the ends of the energizing coil 43 to be economically connected to the coil terminals 5, 5', 5'', such terminals are provided with exposed portions 39 on both sides of the bobbin 1 at the points at which they extend from the bobbin, this arrangement greatly facilitating the establishment of connections by spot welding. In a similar manner, the contact carrier 40 is provided with exposed portions 41, 41' (FIG. 12) extending from a respective end face of the bobbin 1 and permitting spot welding thereto of the root portions 42, 42' of the actuator 3. The current-carrying pole shoes 6, 7 which are provided with fixed contacts 20 are preferably spot welded to their associated contact terminals 4, 4' before being embedded in the bobbin 1. For the purpose of protecting the energizing coil 43, there are provided two preferably identical shell members 44, 44' which are adhesively interconnected or welded together in the plane in which the contact terminals and the coil terminals extend from the bobbin 1. If the transverse surfaces defining the chamber receiving the coil 43 and those on the bobbin flanges 33, 33' are given a conical shape, it is also possible to weld the shells 44, 44' to the bobbin flanges 33, 33'. The two shells may also be formed in such a manner that they cover the exposed portions 39, as shown in FIGS. 12 and 14. As an alternative to this arrangement, FIG. 15 shows a differently designed shell 62 surrounding the energizing coil 43 and shaped to match the external cross section of the bobbin flanges 33, 33' or forming a continuous shell surrounding the bobbin 1. In contrast to the embodiment of FIGS. 8 and 9, the coil terminals 4, 4', 4'' and the contact terminals 5, 5', 5'' forming parts of the respective pre-cut terminal plates are of crooked shape along their portions to be embedded, in such a manner that they extend, for example, towards the exterior of the protective tube 2 within the bobbin flange 33, separation of these terminals from the pre-cut terminal plates being effected after the bending operation.

As an alternative to the embodiments shown in FIGS. 10–15, FIG. 18 shows in a cross section similar to FIG. 15 a relay comprising coil and contact terminals 5, 5' which, while they do not extend from the relay in a single plane, nevertheless form an arrangement typical of a dual-in-line structure. In this case, the space available for the magnet system and a continuous housing can 57 of ferromagnetic material can be more efficiently utilized. In addition, an acutator 3 of greater width may be used, such actuator being provided with a centrally located, longitudinally extending slot 63 permitting employment of twin contacts. For the purpose of positive location of mechanical stabilization and securement of the housing can 57, and of more efficient sealing, the hollow space between the housing can 57 and the relay body is filled with a potting compound 58.

Figure 16:
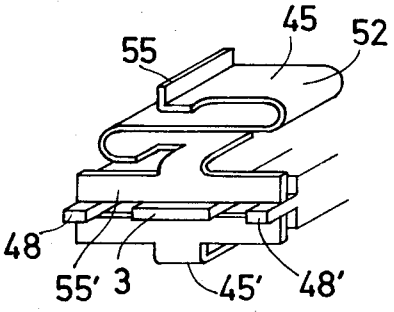
FIG. 16 is an isometric view of two identical centering springs employed in the relay of FIGS. 10–15.
Figure 17:
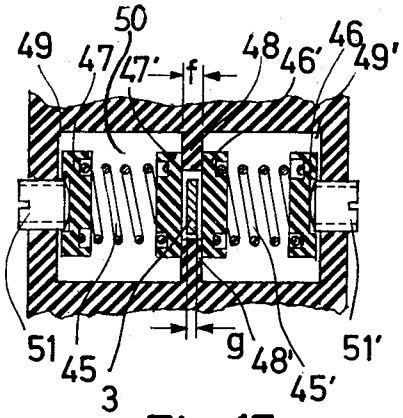
FIG. 17 is a fragmentary cross section illustrating the action of the centering springs of FIG. 16.

The relays described may be designed to afford a rest position of the actuator on one side or on both sides. When it is desired to obtain a relay in which the actuator 3 is capable of assuming a predetermined centered position, the arrangement of FIG. 17 can be adopted according to which supporting plates 46', 47' are positioned on opposite sides of the actuator 3, such supporting plates being urged by adjusting springs 45, 45' against nose-like projections 48, 48' of opposite walls of a cavity containing the adjusting springs. The other ends of the adjusting springs 45, 45' bear against secondary supporting plates 46, 47 which are in turn supported by side walls 49, 49' of the bobbin 1 or by adjusting members, such as adjusting screws 51, 51'. It is convenient in the present case, to select the thickness *f* of the nose-like projections 48, 48' slightly to exceed the thickness *g* of the actuator 3. Suitably shaped adjusting springs 45, 45' are shown in an isometric view in FIG. 16 and in the assembly in FIGS. 10–12. These adjusting springs comprise leaf springs 52, 52', which are bent to S-shape and which are arranged in the vicinity of the free end 9 of the actuator 3. Both ends of each spring 52, 52' are provided with flanges 55, 55' extending at right angles in relation to the respective ends of each spring and are arranged at right angles in relation to one another; these flanges serve the same function as the supporting plates 46 and 46' shown in FIG. 17. The side walls 49, 49' of the cavity 50 receiving the adjusting springs have formed therein groove-like recesses 56, 56' adapted to receive the associated flanges 55 of the two adjusting springs. An adjusting spring of the type just described need only be dropped into the cavity 50, since this spring, according to FIG. 16, is also laterally supported in relation to the inner walls of the bobbin flange 33 and in relation to the permanent magnet 13 by its rigid flange 55 which is of slightly increased width as compared to the width of the flexible part of the spring.

Figure 19:
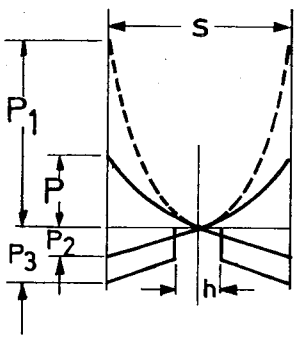
FIG. 19 is a diagram of forces in a relay.

A force diagram applying to this arrangement is shown in FIG. 19. In FIG. 19, the force P of the permanent magnet follows the pattern indicated by the associated symmetrical curve extending across the gap *s* in which the actuator 3 is disposed, this curve applying to the deenergized condition of the relay; the dotted line curve associated with the force P1 illustrates the total magnetic force obtained with the relay in its energized condition. The curve associated with the force P2 indicates the force with which the actuator 3 opposes the magnetic force, and the curves associated with the force P3 illustrate the forces exerted by the two adjusting springs 45, 45'. The length of travel *h* beyond which the adjusting springs come into action is given as the difference between the thickness *f* of the nose-like projections 48, 48' and the thickness *g* of the actuator 3 on the other ($h = f - g$).

What is claimed is:

1. An electromagnetic relay comprising:

a. a bobbin of plastic material defining therein a protective tube, a contact chamber and a magnet chamber that together form a space which extends the entire length of the bobbin and is open at both ends, b. a permanent magnet disposed in the magnet chamber to seal one end of said space, c. a contact actuator mounted to extend along the protective tube with a free end extending into the contact chamber, d. a pair of pole shoes each having a first end disposed in proximity to the permanent magnet and a second end extending into said contact chamber, said second ends forming fixed contacts for cooperation with said free end of the contact actuator, e. a coil mounted on the bobbin, f. means activatable as a getter and disposed in said space, and g. a closure sealing the other end of said space opposite said permanent magnet.

2. An electromagnetic relay according to claim 1, wherein said magnet has a surface exposed to the contact chamber and is made of a material activatable as a getter whereby to constitute said means.

3. An electromagnetic relay according to claim 1, wherein outer end portions of said pole shoes are connected to associated terminals, face said permanent magnet and are embedded in walls of said magnet chamber, each pole shoe having on both sides thereof exposed portions offset in relation to one another by a predetermined distance, some of said exposed portions being arranged in said magnet chamber adjacent an end face of said bobbin.

4. An electromagnetic relay according to claim 1, wherein at least one of the second end of at least one of said pole shoes and the free end of said actuator confronting said second end of said at least one pole shoe is coated with a contact material.

5. An electromagnetic relay according to claim 1, having an outer structure in the shape of a dual-in-line relay.

6. An electromagnetic relay according to claim 5, wherein coil terminals and contact terminals extend in a plane from opposite sides of said bobbin and are then bent to extend in a common direction.

7. An electromagnetic relay according to claim 6, wherein said coil terminals are provided in the plane in which they extend from said bobbin on both sides thereof with exposed portions having the coil welded thereto.

8. An electromagnetic relay according to claim 1, including a contact area having exposed portions extending from an end face of said bobbin and having spot-welded thereto a root portion of said actuator.

9. An electromagnetic relay according to claim 1, wherein said pole shoes are welded to associated contact terminals prior to being embedded in said bobbin.

10. An electromagnetic relay according to claim 6, including two substantially identical shell members made of plastic material and surrounding said coil, said shell members being connected together in the plane in which said contact terminals and said coil terminals extend from said bobbin.

11. An electromagnetic relay according to claim 10, wherein said shell members surrounding said coil also surround exposed portions of said contact and coil terminals.

12. An electromagnetic relay according to claim 10, wherein said shell members surrounding said coil are connected to said bobbin.

13. An electromagnetic relay according to claim 1, wherein said coil is enclosed in a body of plastic material the cross-sectional shape of which matches the external profile of end flanges on said bobbin.

14. An electromagnetic relay according to claim 1, wherein contact spacing defined by contact material provided on the second ends of said pole shoes is so chosen that when the relay is de-energised, the actuator assumes a centered position between the fixed contacts.

15. An electromagnetic relay according to claim 14, wherein, during a contact closing operation, the force exerted on the actuator by the permanent magnet is greater than the restoring force exerted by the resilient actuator, and wherein, for the purpose of returning said actuator to its centered position it is necessary to energize said coil with such a polarity that said coil produces a force exceeding the difference between the force exerted by the permanent magnet and the said restoring force.

16. An electromagnetic relay according to claim 15, wherein, for the purpose of performing a contact closing operation in relation to one of the fixed contacts formed by layers of a contact material provided on the second ends of said pole shoes, it is necessary to energize said coil to a level which is higher than the energizing level required to restore said actuator to its neutral centered position.

17. An electromagnetic relay according to claim 14, including adjusting springs disposed on opposite sides of said actuator for centering the same.

18. An electromagnetic relay according to claim 17, wherein said adjusting springs are preloaded, ends of said springs bearing directly or through the medium of supporting plates against nose-like projections on the one hand and side walls on the other of a cavity in which said adjusting springs are located.

19. An electromagnetic relay according to claim 18, wherein forces exerted by said adjusting springs are independently adjustable by adjusting members for displacing supporting plates provided on side walls of said cavity in which said adjusting springs are located.

20. An electromagnetic relay according to claim 17, wherein said adjusting springs are spiral, helical or telescopic springs.

21. An electromagnetic relay according to claim 17, wherein said adjusting springs are generally bent to S-shape and comprise leaf springs which are arranged in association with the free end of said actuator.

22. An electromagnetic relay according to claim 18, wherein two said nose-like projections are mutually aligned on opposite sides of said actuator, said projections being situated in the plane defined by the centered position of said actuator.

23. An electromagnetic relay according to claim 22, wherein the thickness of said nose-like projections as measured in the direction of the line of action of the forces exerted by said adjusting springs slightly exceeds the thickness of said actuator.

24. An electromagnetic relay according to claim 18, wherein said adjusting springs are provided at both ends thereof with flange portions extending at right angles to said second ends and arranged to bear against side walls of the cavity containing such springs on the one hand and against said nose-like projections on the other or against said actuator with their end faces.

25. An electromagnetic relay according to claim 24, wherein said flanges bent at right angles in relation to the end portions of each adjusting spring extend at right angles in relation to one another.

26. An electromagnetic relay according to claim 24, wherein in the side walls of said cavity housing said adjusting springs there are groove-like recesses receiving one of said end flanges of the adjusting spring associated therewith.

27. An electromagnetic relay according to claim 1, wherein there is a distance between the first end of one pole shoe confronting said permanent magnet and said permanent magnet, said distance being greater than the spacing between the first end of the other pole shoe and said magnet, the mode of operation of said relay as having one of a normally closed contact and a normally open contact depending exclusively on the polarity of a voltage with which said coil is energized and a preload of said actuator.

28. An electromagnetic relay according to claim 2, wherein said permanent magnet is made of barium ferrite or a rare earth to act as a getter.

29. An electromagnetic relay according to claim 1, wherein said permanent magnet is attached to a supporting surface adjacent said contact chamber by means of a piece of foil material carrying an adhesive on both sides thereof, said piece of foil material being so cut as substantially to extend along peripheral portions only of said permanent magnet.

30. An electromagnetic relay according to claim 1, including between said contact chamber and said magnet chamber a cavity for receiving a molecular sieve or an additional getter.

31. An electromagnetic relay according to claim 30, wherein said molecular sieve is fixed in position by thermally induced deformation of terminal wall areas of said bobbin.

32. An electromagnetic relay according to claim 1, wherein the inner walls of said contact chamber are coated with a getter material.

33. An electromagnetic relay according to claim 1, wherein the under side of said bobbin is provided with recesses surrounding contact terminals and coil terminals, said recesses being at least partially filled with a casting resin.

34. An electromagnetic relay according to claim 1, wherein a sealing cap of plastic material the peripheral shape of which matches the cross-sectional shape of an adjacent bobbin flange is welded to said bobbin at a face thereof which faces away from said contact chamber.

35. An electromagnetic relay according to claim 1, wherein said relay is enclosed in a housing can, all spaces between said bobbin and said housing can being filled with a potting compound.

36. An electromagnetic relay according to claim 1, wherein contact terminals and coil terminals extending from said relay are arranged at 5-mm centers.

37. An electromagnetic relay according to claim 1, wherein said space is filled with a protective gas.

38. An electromagnetic relay according to claim 4, wherein said contact material is rolled into the surface of said at least one of the second end of at least one of said pole shoes and the free end of said actuator.

39. An electromagnetic relay according to claim 4, wherein said contact material is rolled onto the surface of said at least one of the second end of at least one of said pole shoes and the free end of said actuator.

40. An electromagnetic relay according to claim 27, including a sheet metal separator having a thickness and arranged in an area adjacent the second end of said one pole shoe, the second end of said other pole shoe and the free end of said actuator confronting the second end of said other pole shoe each being provided with a contact material layer having a thickness, the sum of said distance and the thickness of said sheet metal separator being greater than the spacing between the first end of said other pole shoe and said permanent magnet and the width of the magnetic air gap as determined by the thickness of the contact material layers on the second end of the other pole shoe and the free end of the actuator.

41. An electromagnetic relay according to claim 27, wherein the second end of said other pole shoe and the free end of said actuator confronting the second end of said other pole shoe each are provided with a contact material layer having a thickness, said distance being greater than the spacing between the first end of said other pole shoe and said permanent magnet and the width of the magnetic air gap as determined by the thickness of the contact material layers on the second end of the other pole shoe and the free end of the actuator.

42. An electromagnetic relay according to claim 31, wherein said permanent magnet is fixed in position by thermally induced deformation of terminal wall areas of said bobbin.

43. An electromagnetic relay according to claim 30, wherein said additional getter is fixed in position by thermally induced deformation of terminal wall areas of said bobbin.

44. An electromagnetic relay according to claim 43, wherein said permanent magnet is fixed in position by thermally induced deformation of terminal wall areas of said bobbin.

45. An electromagnetic relay according to claim 30, wherein said permanent magnet is fixed in position by thermally induced deformation of terminal wall areas of said bobbin.

46. An electromagnetic relay according to claim 1, wherein the inner walls of said protective tube are coated with a getter material.

47. An electromagnetic relay according to claim 32, wherein the inner walls of said protective tube are coated with a getter material.

* * * * *